US006284448B1

(12) United States Patent
Suzuki et al.

(10) Patent No.: US 6,284,448 B1
(45) Date of Patent: Sep. 4, 2001

(54) SILVER HALIDE LIGHT SENSITIVE COLOR PHOTOGRAPHIC MATERIAL

(75) Inventors: Takatugu Suzuki; Noriko Ueda; Takayuki Suzuki; Katsuji Ota; Satoru Ikesu, all of Hino (JP)

(73) Assignee: Konica Corporation (JP)

( * ) Notice: Subject to any disclaimer, the term of this patent is extended or adjusted under 35 U.S.C. 154(b) by 0 days.

(21) Appl. No.: 09/604,583

(22) Filed: Jun. 27, 2000

(30) Foreign Application Priority Data

Jun. 29, 1999 (JP) ..... 11-183767

(51) Int. Cl.[7] ..... G03C 1/08; G03C 7/26; G03C 7/32

(52) U.S. Cl. ..... 430/557; 430/544

(58) Field of Search ..... 430/543, 557, 430/544

(56) References Cited

U.S. PATENT DOCUMENTS

| | | | | |
|---|---|---|---|---|
| 3,973,968 | | 8/1976 | Fujiwhara et al. . | |
| 4,269,936 | * | 5/1981 | Arai et al. | 430/557 |
| 5,928,850 | * | 10/2000 | Murai et al. | 430/557 |
| 6,140,032 | * | 10/2000 | Ikesu et al. | 430/557 |

FOREIGN PATENT DOCUMENTS

| | | | |
|---|---|---|---|
| 0415375 | | 3/1991 | (EP) . |
| 0844526 | | 5/1998 | (EP) . |
| 55-538 | * | 1/1980 | (JP) . |

* cited by examiner

*Primary Examiner*—Geraldine Letscher
(74) *Attorney, Agent, or Firm*—Jordon B. Bierman; Bierman, Muserlian and Lucas

(57) ABSTRACT

A silver halide light sensitive color photographic material is disclosed, comprising a support having thereon a silver halide emulsion layer, the photographic material further comprising a 2-equivalent yellow coupler exhibiting superior dye forming capability and enhanced solubility in a solvent, and represented by the following formula:

5 Claims, No Drawings

SILVER HALIDE LIGHT SENSITIVE COLOR PHOTOGRAPHIC MATERIAL

FIELD OF THE INVENTION

The present invention relates to silver halide light sensitive color photographic materials and in particular, to silver halide color photographic materials containing a novel yellow dye forming coupler exhibiting superior dye forming capability, enhanced solubility in solvents and superiority in crystallization property and dispersion stability.

BACKGROUND OF THE INVENTION

Recently, in silver halide light sensitive color photographic materials (hereinafter, also referred to as color photographic materials), two-equivalent couplers tend to be used, in which an appropriate substituent is introduced to the coupling position of the coupler (also called the active point) to react with an oxidized color developing agent, thereby reducing the number of silver atoms needed to form a dye molecule to two silver atoms, instead of the conventionally used four-equivalent couplers which needed four silver atoms to from a dye molecule.

However, requirements for couplers become more severe along with the progress of color photographic materials. Specifically, further improvements in dye formability are desired in terms of enhancements of sensitivity and image quality as well as rapid access.

Representative yellow dye forming couplers (hereinafter, also referred to as yellow couplers) include pivaloylacetoanilide type yellow couplers and benzoylacetoanilide type yellow couplers. As is well known in the art, the benzoylacetoanilide type yellow couplers are generally superior in dye formability. However, commonly known benzoylacetoanilide type yellow couplers are inferior in solubility in solvents, producing problems in manufacturing color photographic materials such that a large amount of a solvent is needed in dispersing the coupler, and defects that after being dispersed in the solvent, crystallization of the coupler tends to occur. These defects are made more marked specifically under the condition of thinner coating, making it a barrier for practical application thereof.

Similarly to the benzoylacetoanilide type yellow couplers, their intermediates are also inferior in solubility in solvents so that a large amount of a solvent is needed in synthesis of the coupler, leading to deteriorated productivity thereof and increased manufacturing cost and causing problems when halogenated solvents are employed, which are superior in solubility but not preferred from the point of view of environment protection.

There have been proposed various techniques to overcome such problems. European Patent (hereinafter, denoted as EP) 327,348 discloses a technique of introducing a branched alkyl group into a benzoylacetoanilide type yellow coupler. Although this technique improved solubility, however, it exhibited the defect that dye forming efficiency is lowered when developed at a lower pH. JP-A 3-84546 (hereinafter, the term, JP-A means an unexamined and published Japanese Patent Application) and EP 897,133 also proposed introduction of a branched alkyl group. However, dye formation is still at an insufficient level and further improvements are desired.

SUMMARY OF THE INVENTION

Accordingly, it is an object of the present invention to provide a silver halide color photographic material containing a novel 2-equivalent yellow coupler exhibiting superior dye forming capability.

It is another object of the invention to provide a silver halide color photographic material containing a novel 2-equivalent yellow coupler exhibiting enhanced solubility in a solvent, and superior crystallization property and dispersion stability.

The objects described above can be accomplished by the following constitution:

1. A silver halide light sensitive color photographic material comprising a coupler represented by the following formula (I):

formula (I)

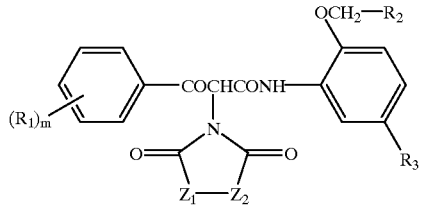

wherein $R_1$ is a substituent; $R_2$ is a branched alkyl group having 7 to 20 carbon atoms; $R_3$ is a hydrogen atom or a halogen atom; m is an integer of 1 to 5; $Z_1$ is >N—$R_4$ or —O—, in which $R_4$ is a hydrogen atom, an alkyl group, a cycloalkyl group, an aryl group or a heterocyclic group; $Z_2$ is >N—$R_5$ or >C($R_6$)($R_7$), in which $R_5$ is a hydrogen atom, an alkyl group, a cycloalkyl group, an aryl group or a heterocyclic group, and $R_6$ and $R_7$ are each a hydrogen atom or a substituent;

2. The silver halide color photographic material described in 1, wherein $R_3$ is a chlorine atom;

3. A silver halide light sensitive color photographic material comprising a coupler represented by the following formula (II):

formula (II)

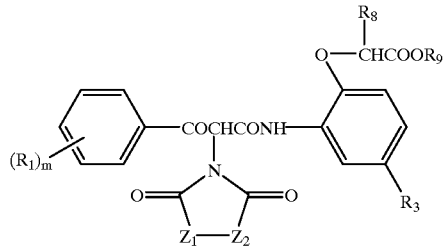

wherein $R_1$ is a substituent; $R_8$ is an alkyl group, a cycloalkyl group or an aryl group; $R_9$ is an alkyl group or a cycloalkyl group, provided that the sum of the carbon number of R8 and R9 is 7 to 20; $R_3$ is a hydrogen atom or a halogen atom; m is an integer of 1 to 5; $Z_1$ is >N—$R_4$ or —O—, in which $R_4$ is a hydrogen atom, an alkyl group, a cycloalkyl group, an aryl group or a heterocyclic group; $Z_2$ is >N—$R_5$ or >C($R_6$)($R_7$), in which $R_5$ is a hydrogen atom, an alkyl group, a cycloalkyl group, an aryl group or a heterocyclic group, and $R_6$ and $R_7$ are each a hydrogen atom or a substituent;

4. The silver halide color photographic material described in 3. above, wherein in formula (II), $R_3$ is a chlorine atom;

5. A silver halide light sensitive color photographic material comprising a coupler represented by the following formula (III):

formula (III)

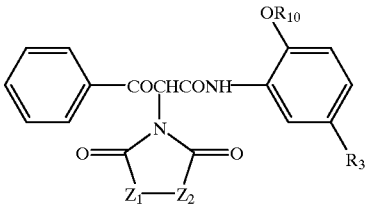

wherein R10 is a ballasted alkyl group; $R_3$ is a hydrogen atom or a halogen atom; $Z_1$ is >N—$R_4$ or —O—, in which $R_4$ is a hydrogen atom, an alkyl group, a cycloalkyl group, an aryl group or a heterocyclic group; $Z_2$ is >N—$R_5$ or >C($R_6$)($R_7$), in which $R_5$ is a hydrogen atom, an alkyl group, a cycloalkyl group, an aryl group or a heterocyclic group, and $R_6$ and $R_7$ are each a hydrogen atom or a substituent;

6. The silver halide color photographic material described in 5 above, wherein in formula (III), $R_3$ is a chlorine atom;
7. The silver halide color photographic material described in 5 or 6 above, wherein $R_{10}$ is an unsubstituted alkyl group having 8 to 21 carbon atom;
8. The silver halide color photographic material described in 5 or 6 above, wherein in formula (III), $R_{10}$ is represented by the following formula (IV):

formula (IV)

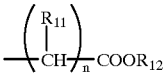

wherein $R_{11}$ is a hydrogen atom, an alkyl group, a cycloalkyl group or an aryl group; $R_{12}$ is an alkyl group or a cycloalkyl group; n is an integer of 1 to 10, provided that when n is 2 or more, plural $R_{11}$'s may be the same or different.

DETAILED DESCRIPTION OF THE INVENTION

In formula (I), examples of the substituent represented by $R_1$ include an alkyl group (e.g., methyl, ethyl, isopropyl, t-butyl, hexyl, dodecyl, etc.), a cycloalkyl group (e.g., cyclopentyl, cyclohexyl, adamantly, etc.), an aryl group (e.g., phenyl, p-t-octylphenyl, etc.), a heterocyclic group (e.g., pyridyl, thiazolyl, oxazolyl, etc.), an alkoxy group (e.g., methoxy, etc.), an aryloxy group (e.g., 2,4-di-t-amylphenoxy, etc.), an alkoxycarbonyl group (e.g., methoxycarbonyl, etc.), an aryloxycarbonyl group (e.g., m-pentadecylphenoxycarbonyl, etc.), a halogen atom (e.g., chlorine, bromine, etc.), a sulfonyl group (e.g., methanesulfonyl, etc.), an acylamino group (e.g., acetylamino, benzoylamino, etc.), a sulfonylamino group (e.g., dodecanesulfonylamino, etc.), nitro, cyano, an amino group (e.g., dimethylamino, anilino, etc.), an alkylthio group (e.g., methylthio, etc.), and hydroxy. Of these, R1 is preferably an alkoxy group, and methoxy is specifically preferred. The substituents represented by $R_1$ may be further substituted.

In formula (I), representative examples of the branched alkyl group having 7 to 20 carbon atoms, represented by $R_2$ include the following groups, but are not limited to these:

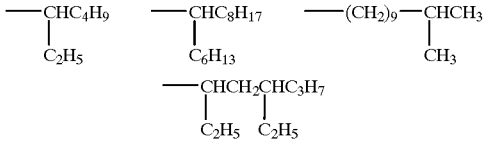

$R_2$ may be substituted, and examples of substituents are the same as defined in the substituent for $R_1$.

In formulas (I), (II) and (III), $R_3$ is a hydrogen atom or a halogen atom, preferably a halogen atom, and more preferably a chlorine atom. In formulas (I) and (II), m is an integer of 1 to 5, preferably 1, and more preferably, the substituting position of R1 is the para-position (or p-position) to the acyl group in formula (I) or (II).

In formulas (I), (II) and (III), $Z_1$ is >N—$R_4$ or —O—, in which $R_4$ is a hydrogen atom, an alkyl group, a cycloalkyl group, an aryl group or a heterocyclic group; $Z_2$ is >N—$R_5$ or >C($R_6$)($R_7$), in which $R_5$ is a hydrogen atom, an alkyl group, a cycloalkyl group, an aryl group or a heterocyclic group, and $R_6$ and $R_7$ are each a hydrogen atom or a substituent.

Examples of the alkyl group, cycloalkyl group, aryl group and heterocyclic group represented by $R_4$ and $R_5$ are the same as defined in those of the alkyl group, cycloalkyl group, aryl group and heterocyclic group of the substituents represented by $R_1$. The alkyl group, cycloalkyl group, aryl group and heterocyclic group represented by $R_4$ and $R_5$ may be further substituted.

Examples of substituents represented by $R_6$ and $R_7$ are the same as those represented by $R_1$ of formula (I). The substituents represented by $R_6$ and $R_7$ may be further substituted.

In formula (II), examples of the alkyl group, cycloalkyl group and aryl group represented by $R_8$ are the same as defined in those of the substituent represented by $R_1$ in formula (I). The alkyl group, cycloalkyl group and aryl group represented by $R_8$ may be further substituted. Examples of the substituents are the same as those defined in $R_1$ of formula (I).

The alkyl group and cycloalkyl group represented by $R_9$ of formula (II) are the same as defined in those represented by $R_1$ of formula (I). The alkyl group and cycloalkyl group represented by $R_9$ may be further substituted. Examples of the substituents are the same as those defined in $R_1$ of formula (I). The total carbon number of $R_8$ and $R_9$ are 7 to 20.

In formula (III), the ballasted alkyl group represented by $R_{10}$ is an alky group of such size and configuration as to confer on the coupler molecule sufficient bulk to render the coupler substantially non-diffusible from the layer into which it is incorporated in the photographic material. The ballasted alkyl group is preferably an alkyl group having 8 to 21 carbon atoms, including straight-chained or branched ones. Examples thereof include octyl, 2-ethylhexyl, decyl, 2,4-diethylheptyl, dodecyl, isotridecyl, tetradecyl, hexadecyl, 2-hexyldecyl and octadecyl. Further, the ballasted alkyl group represented by $R_{10}$ may be substituted by substituent(s). Examples of the substituent(s) are the same as those defined by $R_1$ of formula (I). In this case, the total carbon number including the substituent is preferably 9 to 30.

In formula (IV), the alkyl group, cycloalkyl group and aryl group represented by $R_{11}$ are the same as those defined by R1 of formula (I). Further, the alkyl group, cycloalkyl group and aryl group represented by $R_{11}$ may be substituted by substituent(s). Examples of the substituent(s) include the same as those defined by $R_1$ of formula (I).

In formula (IV), the alkyl group or cyloalkyl group represented by $R_{12}$ are the same as those defined in $R_1$ of formula (I). Further, the alkyl group and cyloalkyl group represented by $R_{12}$ may be substituted by substituent(s) Examples of the substituent(s) include the same as those defined in $R_1$ of formula (I).

In formula (IV), n is an integer of 1 to 10. When n is 2 or more, plural $R_{11}$'s may be the same with or different from each other. The total carbon number of the group defined by formula (IV) is preferably 9 to 22, and more preferably 10 to 22.

In formula (III), $R_{10}$ is specifically preferrably an unsubstituted alkyl group having 8 to 21 carbon atoms.

The 2-equivalent yellow coupler represented by formula (I), (II) or (III) may be linked at any substituent to form a bis-body, tris-body, tetrakis-body or polymer-body.

Of these coupler compounds represented by formulas (I), (II) and (III), the compound represented by formula (III) is specifically preferred.

Exemplary examples of 2-equivalent yellow couplers represented by formulas (I), (II) and (III) are shown below, but are not limited to these.

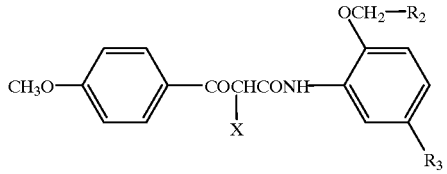

| No. | $R_2$ | $R_3$ | X |
|---|---|---|---|
| I-1 | —CH(C4H9)(C2H5) | Cl | 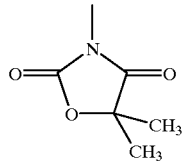 |
| I-2 | —CH(C4H9)(C2H5) | Cl | 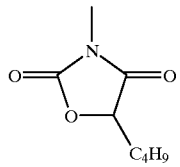 |
| I-3 | —CH(C4H9)(C2H5) | Cl | 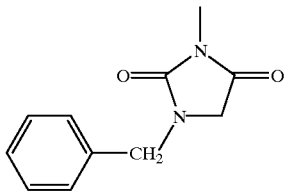 |
| I-4 | —CH(C4H9)(C2H5) | Cl | 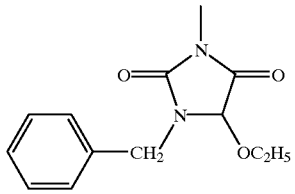 |
| I-5 | —CH(C4H9)(C2H5) | Br | 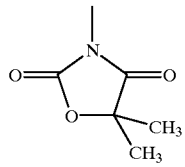 |

-continued
| | | | |
|---|---|---|---|
| I-6 | $-CH(C_2H_5)C_4H_9$ | Cl | 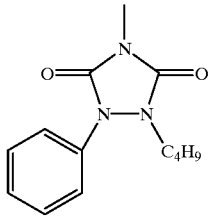 |
| I-7 | $-CH(C_6H_{13})C_8H_{17}$ | Cl | 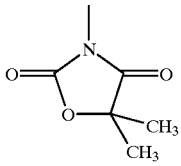 |
| I-8 | $-(CH_2)_9CH(CH_3)CH_3$ | Cl | 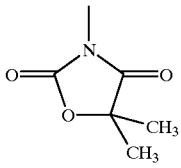 |
| I-9 | $-CH(C_2H_5)C_4H_9$ | H | 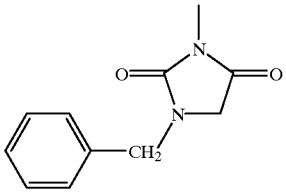 |
| I-10 | $-CH(C_2H_5)C_4H_9$ | Cl | 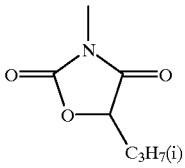 |
| I-11 | $-CH(CH_3)C_{14}H_{29}$ | Cl | 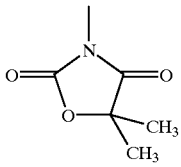 |
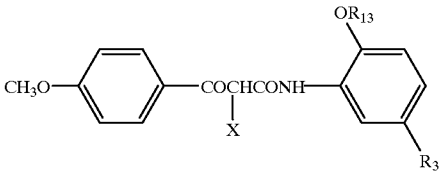
| No. | $R_{13}$ | $R_3$ | X |
|---|---|---|---|
| II-1 | $-CH(CH_3)COOC_8H_{17}$ | Cl | 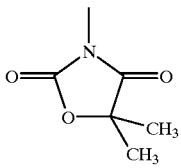 |

-continued
| | | | |
|---|---|---|---|
| II-2 | —CH(CH$_3$)COOC$_8$H$_{17}$ | Cl | 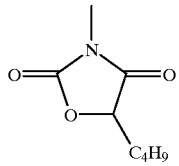 |
| II-3 | —CH(CH$_3$)COOC$_8$H$_{17}$ | Cl | 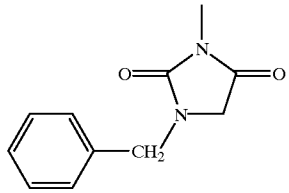 |
| II-4 | —CH(CH$_3$)COOC$_{12}$H$_{25}$ | Cl | 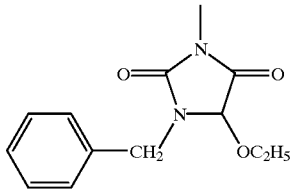 |
| II-5 | —CH(C$_6$H$_{13}$)COOC$_2$H$_5$ | F | 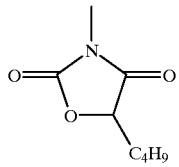 |
| II-6 | —CH(C$_{12}$H$_{25}$)COOCH$_3$ | Cl | 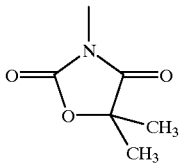 |
| II-7 | —CH(C$_{10}$H$_{21}$)COOC$_3$H$_7$(i) | Cl | 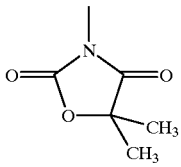 |
| II-8 | —CH(CH$_3$)COOC$_8$H$_{17}$ | Cl | 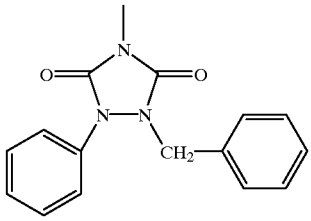 |

-continued
| | | | |
|---|---|---|---|
| II-9 | —CH(C$_4$H$_9$)COOC$_{12}$H$_{25}$ | H | 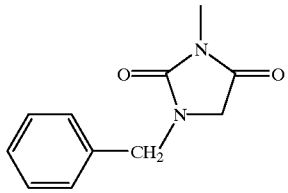 |
| II-10 | —CH(CH$_3$)COOC$_{12}$H$_{25}$ | Cl | 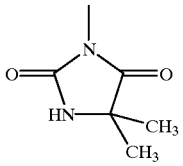 |
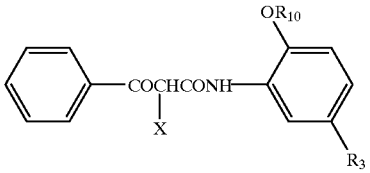
| No. | $R_{10}$ | $R_3$ | X |
|---|---|---|---|
| III-1 | —C$_{12}$H$_{24}$ | Cl | 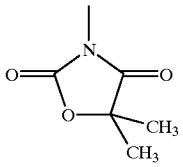 |
| III-2 | —C$_{12}$H$_{25}$ | Cl | 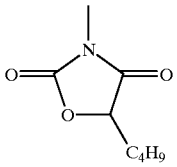 |
| III-3 | —C$_{12}$H$_{25}$ | Cl | 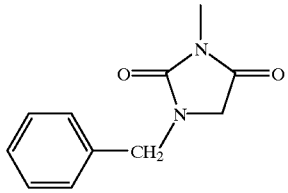 |
| III-4 | —CH$_2$CH(C$_2$H$_5$)C$_4$H$_9$ | Cl | 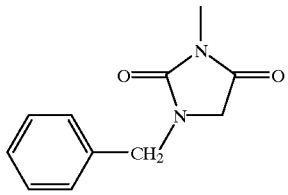 |
| III-5 | —CH$_2$CH(C$_2$H$_5$)C$_4$H$_9$ | Cl | 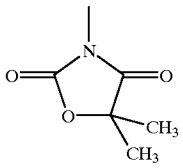 |

-continued
| | | | |
|---|---|---|---|
| III-6 | $-CH_2CH(C_2H_5)C_4H_9$ | Cl | 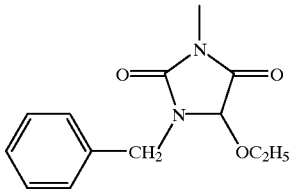 |
| III-7 | $-CH_2CH(C_2H_5)C_4H_9$ | Cl | 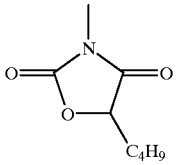 |
| III-8 | $-(CH_2)_9CH(CH_3)CH_3$ | Cl | 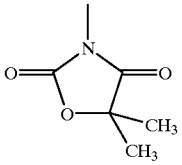 |
| III-9 | $-C_{16}H_{33}$ | Cl | 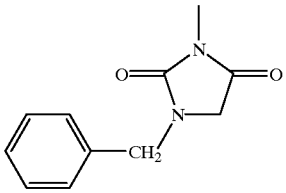 |
| III-10 | $-C_{16}H_{33}$ | Cl | 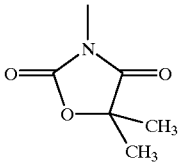 |
| III-11 | $-C_{12}H_{25}$ | Cl | 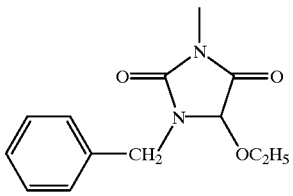 |
| III-12 | $-C_{16}H_{33}$ | Cl | 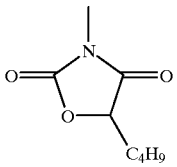 |
| III-13 | $-C_8H_{17}$ | Cl | 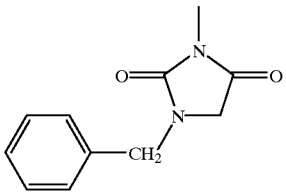 |

-continued
| | | | |
|---|---|---|---|
| III-14 | —$CH_2CHC_4H_9$ (with $C_2H_5$) | Cl | 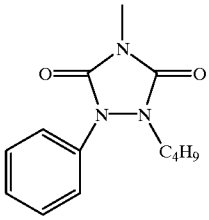 |
| III-15 | —$C_{18}H_{37}$ | Cl | 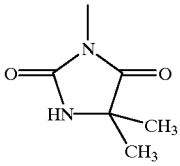 |
| III-16 | —$CH_2CHC_4H_9$ (with $C_2H_5$) | H | 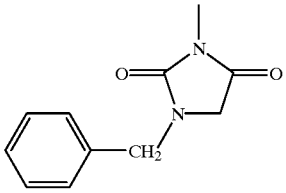 |
| III-17 | —$C_{12}H_{25}$ | Br | 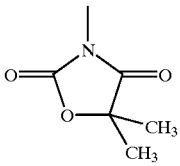 |
| III-18 | —$C_{14}H_{29}$ | Cl | 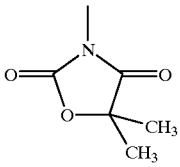 |
| III-19 | —$C_{12}H_{25}$ | F | 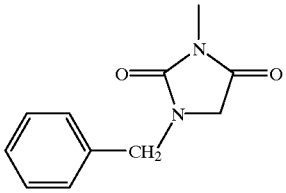 |
| III-20 | —$C_{10}H_{21}$ | Cl | 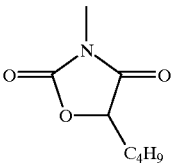 |
| III-21 | —$CHCOOC_8H_{17}$ ($CH_3$) | Cl | 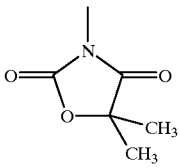 |

-continued
| | | | |
|---|---|---|---|
| III-22 | —CHCOOC$_8$H$_{17}$<br>\|<br>CH$_3$ | Cl | 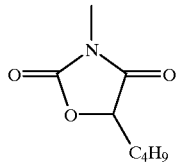 |
| III-23 | —CHCOOC$_8$H$_{17}$<br>\|<br>CH$_3$ | Cl | 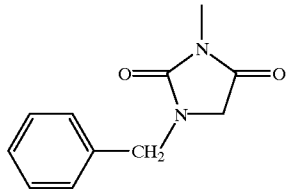 |
| III-24 | —CHCOOC$_{12}$H$_{25}$<br>\|<br>CH$_3$ | Cl | 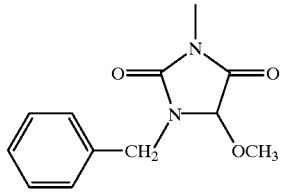 |
| III-25 | —CHCOOC$_2$H$_5$<br>\|<br>C$_6$H$_{13}$ | F | 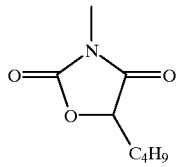 |
| III-26 | —CHCOOCH$_3$<br>\|<br>C$_{12}$H$_{25}$ | Cl | 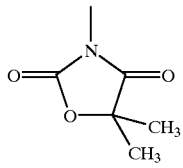 |
| III-27 | —CHCOOC$_3$H$_7$(i)<br>\|<br>C$_{10}$H$_{21}$ | Cl | 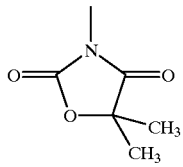 |
| III-28 | —CHCOOC$_8$H$_{17}$<br>\|<br>CH$_3$ | Cl | 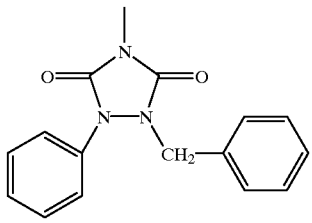 |

-continued

| | | | |
|---|---|---|---|
| III-29 | —CH(C$_4$H$_9$)COOC$_{12}$H$_{25}$ | H | |
| III-30 | —CH(CH$_3$)COOC$_{12}$H$_{25}$ | Cl | |
| III-31 | —CH(CH$_3$)COOC$_{12}$H$_{25}$ | Cl | |
| III-32 | —CH(C$_{12}$H$_{25}$)COOCH$_3$ | Cl | |
| III-33 | —CH$_2$CH$_2$COOC$_8$H$_{17}$ | Cl | |
| III-34 | —(CH$_2$)$_{10}$COOC$_2$H$_5$ | H | |
| III-35 | —CH(CH$_3$)COOC$_8$H$_{17}$ | Cl | |
| III-36 | —CH(C$_{12}$H$_{25}$)COOC$_4$H$_9$(t) | Cl | |

-continued
| | | | |
|---|---|---|---|
| III-37 | —CH(CH$_3$)CH$_2$COOC$_{12}$H$_{25}$ | Cl | 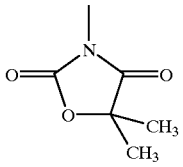 |
| III-38 | —CH$_2$COOC$_{12}$H$_{25}$ | Cl | 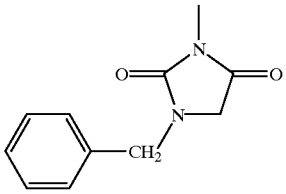 |
| III-39 | —CH(CH$_3$)CON(C$_8$H$_{17}$)$_2$ | Cl | 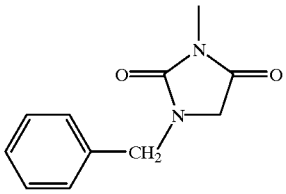 |
| III-40 | 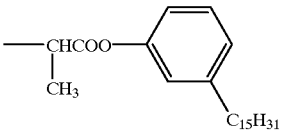 | Cl | 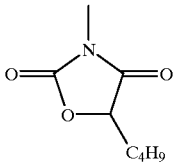 |
| III-41 | —C$_{14}$H$_{29}$ | Cl | 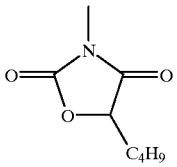 |
| III-42 | —C$_{14}$H$_{29}$ | Cl | 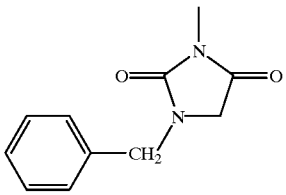 |
| III-43 | —C$_{18}$H$_{37}$ | Cl | 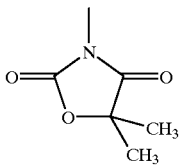 |
| III-44 | —C$_{18}$H$_{37}$ | Cl | 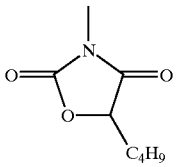 |

-continued

| | | | |
|---|---|---|---|
| III-45 | $—(CH_2)_3COOC_8H_{17}$ | Cl | 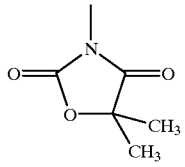 |
| III-46 | $—(CH_2)_4COOC_8H_{17}$ | Cl | 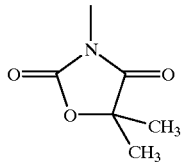 |

Yellow couplers represented by formulas (I), (II) and (III) can be readily synthesized according to the methods known in the art. Exemplary examples of the synthesis thereof are given below.

SYNTHESIS EXAMPLE 1

Exemplified coupler I-1 was prepared according to the following scheme:

Synthesis scheme

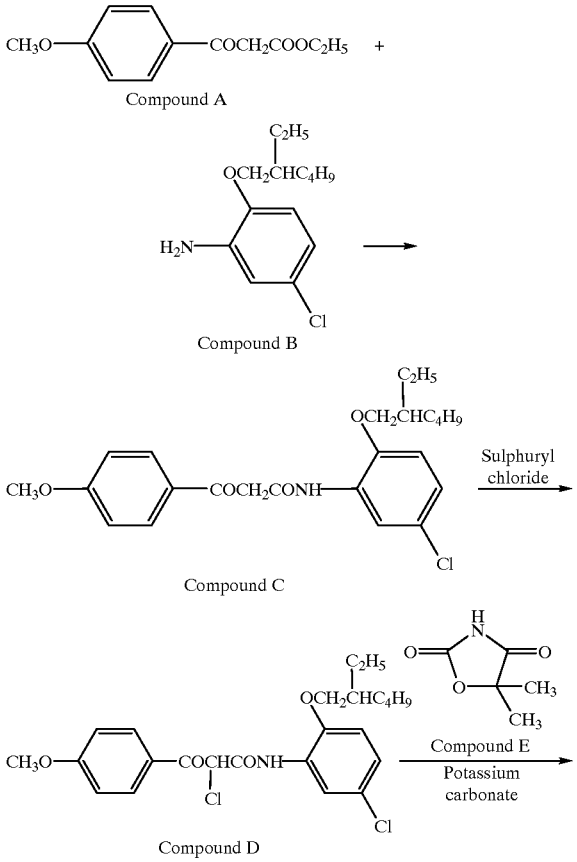

-continued

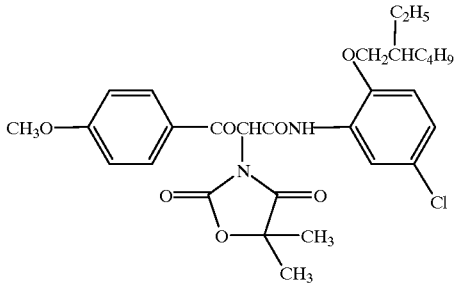

Exemplified coupler I-1 i) Synthesis of Compound C

A mixture of 26.1 g of compound A and 25.0 g of compound B in 125 ml of xylene was heated to reflux for a period of 3 hrs., while ethanol produced was distilled away. After completion of reaction, the solvent was recovered under reduced pressure and the residue was allowed to recrystallize from 210 ml of acetonitrile to obtain 33.2 g of compound C (yield: 79%).

ii) Synthesis of Compound D

Compound C of 30.0 g was dissolved in 90 ml of toluene and 9.37 g of sulphuryl chloride was slowly dropwise added thereto at a temperature of 30° C. After completion of addition, the reaction mixture was stirred at the same temperature for a period of 1.5 hrs. and thereafter, the solvent was recovered under reduced pressure to obtain 32.4 g of compound D (yield: 100%). Compound D was used in the next reaction without purification.

iii) Synthesis of Exemplified Coupler I-1

Compound D of 32.4 g was dissolved in 180 ml of acetone, 12.5 g of potassium carbonate and 11.7 g of compound E were added thereto and the mixture was heated to reflux for 3 hrs. After completion of reaction, ethyl acetate and water were added thereto, and an organic phase was extracted, washed with diluted aqueous hydrochloric acid and further washed with water three times. Thereafter, the solvent was recovered under reduced pressure and the residue was allowed to recrystallize in 120 ml methanol to obtain 29.2 g of exemplified coupler I-1 (yield: 75%). The melting point was 108 to 109° C. The structure of coupler I-1 was identified by NMR, IR and mass spectrum.

SYNTHESIS EXAMPLE 2

Exemplified coupler II-2 was synthesized according to following scheme:

Synthesis scheme

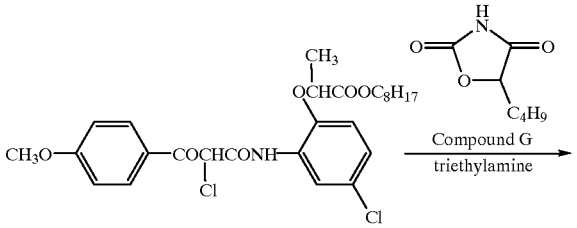

Compound F

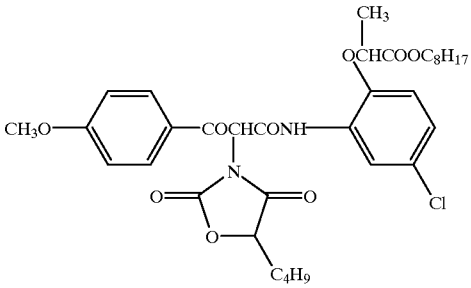

Exemplified coupler II-2

-continued

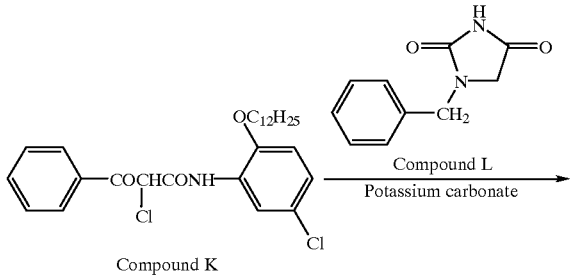

Compound K

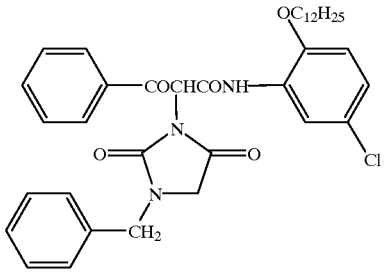

Exemplified coupler III-3 i) Synthesis of Exemplified Coupler

Compound F of 25.0 g was dissolved in 75 ml of ethyl acetate, 5.64 g of triethylamine and 8.76 g of compound G were added thereto and the mixture was heated to reflux for a period of 5 hrs. After completion of reaction, 100 ml of water was added thereto and an organic phase was extracted. Thereafter, the reaction product was washed with diluted sulfuric acid and further with water three times. Then, the solvent was removed under reduced pressure. The obtained residue was refined through column chromatography (silica gel, developing solvent of ethyl acetate/n-hexane) to obtain oily coupler II-2 of 24.8 g (yield:81%). The structure of coupler II-2 was identified by NMR, IR and mass spectrum.

SYNTHESIS EXAMPLE 3

Exemplified coupler III-3 was synthesized according to the following scheme.

Synthesis scheme

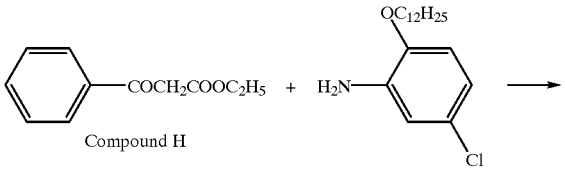

Compound H

Compound I

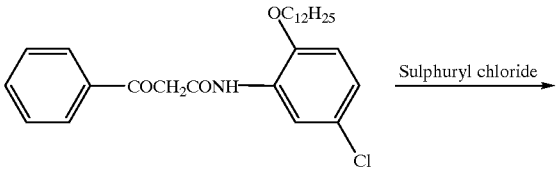

Compound J

SYNTHESIS OF COMPOUND J

A mixture of 120 g of compound H and 177 g of compound I in 885 ml of toluene was heated to reflux for a period of 12 hrs., while ethanol produced was distilled away. After completion of reaction, the solvent was recovered under reduced pressure and the residue was allowed to recrystallize in 780 ml of ethanol to obtain compound of 238 g (yield: 92%).

ii) Synthesis of Compound K

Compound J of 200 g was dissolved in 600 ml of toluene and 58.8 g of sulphuryl chloride was slowly added dropwise thereto at a temperature of 40° C. After completion of addition, the reaction mixture was stirred at the same temperature for a period of 3 hrs., thereafter, the solvent was recovered under reduced pressure to obtain 215 g of compound K (yield: 100%). Compound K was used in the next reaction without purification.

iii) Synthesis of Exemplified Coupler III-3

Compound K of 215 g was dissolved in 645 ml of acetone, 78.3 g of potassium carbonate and 108 g of compound L were added thereto and the mixture was heated to reflux for 3 hrs. After completion of reaction, ethyl acetate and water were added thereto, and an organic phase was extracted, washed with diluted aqueous hydrochloric acid and further washed with water three time. Thereafter, the solvent was recovered under reduced pressure and the residue was allowed to recrystallize in 1400 ml methanol to obtain 237 g of exemplified coupler III-3 (yield: 84%). The melting point was 103 to 104° C. The structure of coupler III-3 was identified by NMR, IR and mass spectrum.

SYNTHESIS EXAMPLE 4

Exemplified coupler III-32 was synthesized according to the following synthesis scheme:

Synthesis scheme

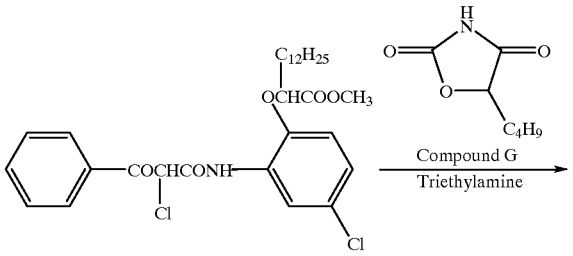

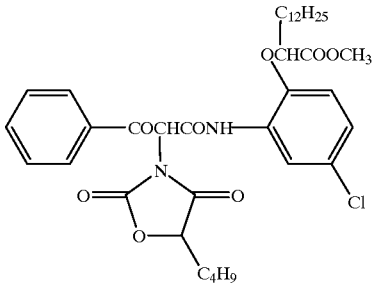

Exemplified coupler III-32 i) Synthesis of Exemplified Coupler III-32

Compound M of 10.0 g was dissolved in 30 ml of ethyl acetate, 2.15 g of triethylamine and 3.34 g of compound G were added thereto and the mixture was heated to reflux for a period of 5 hrs. After completion of reaction, 50 ml of water was added thereto and an organic phase was extracted. Thereafter, the reaction product was washed with diluted sulfuric acid and further with water three times. Then, the solvent was removed under reduced pressure. The obtained residue was refined through column chromatography (silica gel, developing solvent of ethyl acetate/n-hexane) to obtain oily coupler III-32 of 8.74 g (yield:72%). The structure of coupler III-32 was identified by NMR, IR and mass spectrum.

Couplers other than exemplified couplers I-1, II-2, III-3 and III-32 were prepared using corresponding starting raw materials, in a similar manner to the methods described above.

The yellow coupler according to this invention can be used alone or in combination. The yellow coupler can also be used in combination with commonly known pivaloylaceto anilide yellow couplers or benzoylacetoanilide yellow couplers.

To incorporate the yellow coupler of this invention into a silver halide emulsion of a silver halide color photographic material, the coupler is allowed to dissolve in a high boiling organic solvent having a boiling point of 175° C. or higher, such as tricresyl phosphate or dibutyl phthalate and one or more kinds of commonly used low boiling organic solvents such as ethyl acetate, methanol, acetone, chloroform, methyl chloride or butyl propionate, then mixed with an aqueous gelatin solution containing a surfactant, and dispersed by means of a high-speed rotation mixer or a colloid mill. The thus obtained emulsified dispersion was directly added to the silver halide emulsion. Alternatively, the emulsified dispersion is set and shredded to noodles; then, after removing the low boiling solvent by a means such as washing, the emulsified coupler is added into the silver halide emulsion.

The yellow coupler according to this invention is incorporated preferably in an amount of 1×10−3 to 1 mol per mol of silver halide but the amount to be incorporated can be varied, depending on the purpose of usage.

Silver halide color photographic material relating to the invention include various kinds or application thereof. Examples of silver halide to be used include silver chloride, silver bromide, silver iodide, silver chlorobromide, silver iodobromide and silver iodochlorobromide. Silver halide color photographic materials used in this invention may contain dye forming couplers other than the yellow coupler relating to this invention to form multi-color images.

Silver halide color photographic materials used in this invention may further contain an color-fog inhibitor, an image stabilizer, a hardener, a plasticizer, a polymeric latex, a formalin scavenger, a dye mordant, a development accelerator, a development inhibitor, a fluorescent brightener, a matting agent, a solvent, antistatic agent or a surfactant. Further, incorporation of a UV absorbent into a silver halide color photographic material containing the yellow coupler of this invention can enhance fastness of yellow images produced in the photographic material.

EXAMPLES

Embodiments of the present invention will be further described based on examples but are not limited to these examples.

Example 1

Yellow couplers according to the invention as shown in Table 1 or comparative couplers shown below, 1.0 g of each was added into a mixture of 0.4 g of tricresyl phosphate and 2.6 g of ethyl acetate and heated at 70° C. to dissolve. To the solution, an aqueous solution in which 0.7 g of gelatin and 80 mg of Alkanol XC were dissolved in 13.2 g of water at 45° C., was added and the mixture was dispersed by using a ultrasonic homogenizer to obtain an emulsified dispersion of yellow couplers, as shown in Table 1. After completion of dispersing, water was added to the dispersion to make up 20 g. After being stocked in a refrigerator for a period of 2 weeks, the dispersion of each coupler was microscopically observed to evaluate its crystallization property. Results are shown in Table 1. Couplers used for comparison are as follows.

Comparative coupler Y-1

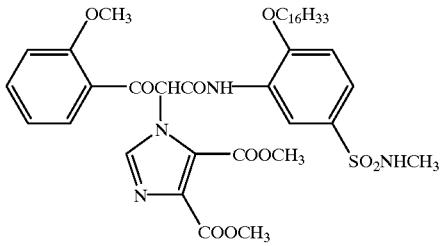

(Coupler described in JP-A 50-34232)

-continued

Comparative coupler Y-2

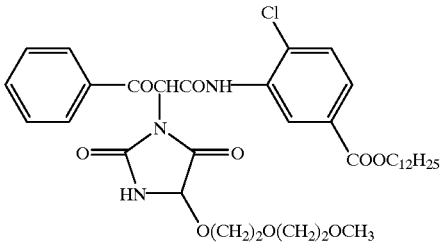

(Coupler described in JP-A 51-102636)

Comparative coupler Y-3

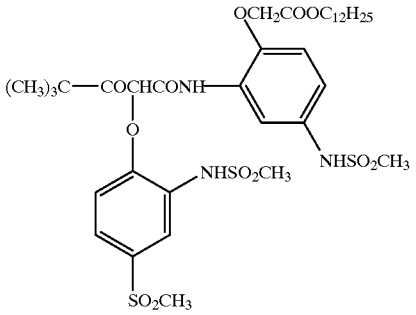

(Coupler described in EP 416,684)

Comparative coupler Y-4

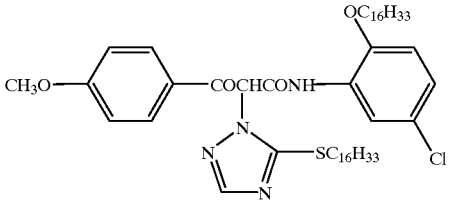

(Coupler described in U.S. Pat. 4,833,070)

TABLE 1

| Yellow Coupler Dispersion | Coupler | State After Storage |
|---|---|---|
| 1 (Inv.) | I-1 | No crystallization observed |
| 2 (Inv.) | II-2 | No crystallization observed |
| 3 (Inv.) | III-3 | No crystallization observed |
| 4 (Inv.) | III-32 | No crystallization observed |
| 5 (Comp.) | Y-1 | Slight crystallization observed |
| 6 (Comp.) | Y-2 | marked crystallization observed |
| 7 (Comp.) | Y-3 | Slight crystallization observed |
| 8 (Comp.) | Y-4 | Crystallization observed |

As apparent from Table 1, it was proved that the use of yellow couplers according to the invention exhibited superior dispersion stability without crystallization, as compared to comparative couplers.

Example 2

On a triacetyl cellulose film support were formed the following layers containing composition as shown below to prepare a multi-layered color photographic material Sample 201. The addition amount of each compound was represented in term of g/m$^2$, provided that the amount of silver halide or colloidal silver was converted to the silver amount and the amount of a sensitizing dye (denoted as "SD") was represented in mol/Ag mol.

| | |
|---|---|
| 1st Layer (Anti-Halation Layer) | |
| Black colloidal silver | 0.16 |
| UV-3 | 0.3 |
| CM-1 | 0.123 |
| CC-1 | 0.044 |
| OIL-1 | 0.167 |
| Gelatin | 1.33 |
| 2nd Layer (Intermediate Layer) | |
| AS-1 | 0.160 |
| OIL-1 | 0.20 |
| Gelatin | 0.69 |
| 3rd Layer (Low-speed Red-Sensitive Layer) | |
| Silver iodobromide a | 0.20 |
| Silver iodobromide b | 0.29 |
| SD-1 | $2.37 \times 10^{-5}$ |
| SD-2 | $1.2 \times 10^{-4}$ |
| SD-3 | $2.4 \times 10^{-4}$ |
| SD-4 | $2.4 \times 10^{-6}$ |
| C-3 | 0.32 |
| CC-1 | 0.038 |
| OIL-2 | 0.28 |
| AS-2 | 0.002 |
| Gelatin | 0.73 |
| 4th Layer (Medium-speed Red-sensitive Layer) | |
| Silver iodobromide c | 0.10 |
| Silver iodobromide d | 0.86 |
| SD-1 | $4.5 \times 10^{-5}$ |
| SD-2 | $2.3 \times 10^{-4}$ |
| SD-3 | $4.5 \times 10^{-4}$ |
| C-2 | 0.52 |
| CC-1 | 0.06 |
| DI-1 | 0.047 |
| OIL-2 | 0.46 |
| AS-2 | 0.004 |
| Gelatin | 1.30 |
| 5th Layer (High-speed Red-sensitive Layer) | |
| Silver iodobromide c | 0.13 |
| Silver iodobromide d | 1.18 |
| SD-1 | $3.0 \times 10^{-5}$ |
| SD-2 | $1.5 \times 10^{-4}$ |
| SD-3 | $3.0 \times 10^{-4}$ |
| C-4 | 0.047 |
| C-5 | 0.09 |
| CC-1 | 0.036 |
| DI-1 | 0.024 |
| OIL-2 | 0.27 |
| AS-2 | 0.006 |
| Gelatin | 1.28 |
| 6th Layer (Intermediate Layer) | |
| OIL-1 | 0.29 |
| AS-1 | 0.23 |
| Gelatin | 1.00 |
| 7th Layer (Low-speed Green-sensitive Layer) | |
| Silver iodobromide a | 0.19 |
| Silver iodobromide b | 0.062 |
| SD-4 | $3.6 \times 10^{-4}$ |
| SD-5 | $3.6 \times 10^{-4}$ |
| M-1 | 0.21 |
| CM-1 | 0.033 |
| OIL-1 | 0.22 |
| AS-2 | 0.002 |
| AS-3 | 0.05 |
| Gelatin | 0.61 |
| 8th layer (Interlayer) | |
| OIL-1 | 0.26 |
| AS-1 | 0.054 |
| Gelatin | 0.80 |
| 9th Layer (Medium-speed Green-sensitive Layer) | |
| Silver iodobromide e | 0.54 |
| Silver iodobromide f | 0.54 |

-continued

| | |
|---|---|
| SD-6 | $3.7 \times 10^{-4}$ |
| SD-7 | $7.4 \times 10^{-5}$ |
| SD-8 | $5.0 \times 10^{-5}$ |
| M-1 | 0.17 |
| CM-1 | 0.024 |
| CM-2 | 0.029 |
| DI-2 | 0.024 |
| DI-3 | 0.005 |
| OIL-1 | 0.73 |
| AS-2 | 0.003 |
| AS-3 | 0.035 |
| Gelatin | 1.80 |
| 10th Layer (High-speed Green-sensitive Layer) | |
| Silver iodobromide f | 1.19 |
| SD-6 | $4.0 \times 10^{-4}$ |
| SD-7 | $8.0 \times 10^{-5}$ |
| SD-8 | $5.0 \times 10^{-5}$ |
| M-1 | 0.09 |
| CM-1 | 0.022 |
| CM-2 | 0.026 |
| DI-2 | 0.003 |
| DI-3 | 0.003 |
| OIL-1 | 0.19 |
| OIL-2 | 0.43 |
| AS-2 | 0.014 |
| AS-3 | 0.017 |
| Gelatin | 1.23 |
| 11th Layer (Yellow Filter Layer) | |
| Yellow colloidal silver | 0.05 |
| OIL-1 | 0.18 |
| AS-1 | 0.16 |
| Gelatin | 1.00 |
| 12th Layer (Low-speed Blue-sensitive Layer) | |
| Silver iodobromide a | 0.08 |
| Silver iodobromide b | 0.22 |
| Silver iodobromide h | 0.09 |
| SD-9 | $6.5 \times 10^{-4}$ |
| SD-10 | $2.5 \times 10^{-4}$ |
| Y-5 | 0.77 |
| DI-4 | 0.017 |
| OIL-1 | 0.31 |
| AS-2 | 0.002 |
| Gelatin | 1.29 |
| 13th Layer (High-sped Blue-sensitive Layer) | |
| Silver iodobromide h | 0.41 |
| Silver iodobromide i | 0.61 |
| SD-9 | $4.4 \times 10^{-4}$ |
| SD-10 | $1.5 \times 10^{-4}$ |
| Y-5 | 0.23 |
| OIL-1 | 0.10 |
| AS-2 | 0.004 |
| Gelatin | 1.20 |
| 14th Layer (First Protective Layer) | |
| Silver iodobromide j | 0.30 |
| UV-3 | 0.055 |
| UV-4 | 0.110 |
| OIL-2 | 0.30 |
| Gelatin | 1.32 |
| 15th Layer (Second Protective Layer) | |
| PM-1 | 0.15 |
| PM-2 | 0.04 |
| WAX-1 | 0.02 |
| AI-5 | 0.001 |
| Gelatin | 0.55 |

Characteristics of silver iodobromide emulsions described above are shown below, in which the average grain size refers to an edge length of a cube having the same volume as that of the grain.

| Emulsion | Av. grain size (μm) | Av. AgI content (mol %) | Diameter/thickness ratio |
|---|---|---|---|
| a | 0.30 | 2.0 | 1.0 |
| b | 0.40 | 8.0 | 1.4 |
| c | 0.60 | 7.0 | 3.1 |
| d | 0.74 | 7.0 | 5.0 |
| e | 0.60 | 7.0 | 4.1 |
| f | 0.65 | 8.7 | 6.5 |
| h | 0.65 | 8.0 | 1.4 |
| i | 1.00 | 8.0 | 2.0 |
| j | 0.05 | 2.0 | 1.0 |

Of the emulsions described above, for example, silver iodobromide d and f were prepared according to the following procedure described below. Silver iodobromide j was prepared by reference to JP-A 1-183417, 1-183644, 1-183645 and 2-166442.

Preparation of Seed Emulsion-1

To Solution Al maintained at 35° C. and stirred with a mixing stirrer described in JP-B 58-58288 and 58-58289 were added an aqueous silver nitrate solution (1.161 mol) and an aqueous potassium bromide and potassium iodide mixture solution (containing 2 mol % potassium iodide) by the double jet method in 2 min., while keeping the silver potential at 0 mV (measured with a silver electrode and a saturated silver-silver chloride electrode as a reference electrode), to form nucleus grains. Then the temperature was raised to 60° C. in 60 min. and after the pH was adjusted to 5.0 with an aqueous sodium carbonate solution, an aqueous silver nitrate solution (5.902 mol) and an aqueous potassium bromide and potassium iodide mixture solution (containing 2 mol % potassium iodide) were added by the double jet method in 42 minutes, while keeping the silver potential at 9 mV. After completing the addition, the temperature was lowered to 40° C. and the emulsion was desalted according to the conventional flocculation washing. The obtained seed emulsion was comprised of grains having an average equivalent sphere diameter of 0.24 μm and an average aspect ratio of 4.8. At least 90% of the total grain projected area was accounted for by hexagonal tabular grains having the maximum edge ratio of 1.0 to 2.0. This emulsion was denoted as Seed Emulsion-1

| Solution A1 | |
|---|---|
| Ossein gelatin | 24.2 g |
| Potassium bromide | 10.8 g |
| $HO(CH_2CH_2O)m(CH(CH_3)CH_2O)_{19.8}(CH_2CH_2O)nH$ | 6.78 ml |
| (10% ethanol solution) | 6.78 ml |
| 10% Nitrate | 114 ml |
| Distilled water to make | 9657 ml |

Preparation of Fine Silver Iodide Grain Emulsion SMC-1

To 5 liters of a 6.0 wt. % gelatin solution containing 0.06 mol of potassium iodide, an aqueous solution containing 7.06 mol of silver nitrate and an aqueous solution containing 7.06 mol of potassium iodide, 2 liters of each were added over a period of 10 min., while the pH was maintained at 2.0 using nitric acid and the temperature was maintained at 40° C. After completion of grain formation, the pH was adjusted to 6.0 using a sodium carbonate aqueous solution. The resulting emulsion was comprised of fine silver iodide grains having an average diameter of 0.05 μm, and was denoted as SMC-1.

Preparation of Silver Iodobromide d 700 ml of an aqueous 4.5 wt. % inert gelatin solution containing 0.178 mol equivalent of Seed Emulsion-1 and 0.5 ml of a 10% ethanol solution of $$HO(CH_2CH_2O)m(CH(CH_3)CH_2O)_{19.8}(CH_2CH_2O)nH$$

was maintained at 75° C. and after adjusting the pAg and pH to 8.3 and 5.0, respectively, a silver halide emulsion was prepared while vigorously stirring, according to the following procedure.

1) An aqueous silver nitrate solution of 3.093 mol, SMC-1 of 0.287 mol and an aqueous potassium bromide solution were added by the double jet method while keeping the pAg and pH were maintained at 8.4 and 5.0, respectively.

2) Subsequently, the temperature was lowered to 60° C. and the pAg was adjusted to 9.8. Then, SMC-1 of 0.071 mol was added and ripened for 2 min (introduction of dislocation lines).

3) Further, an aqueous silver nitrate solution of 0.959 mol, SMC-1 of 0.030 mol and an aqueous potassium bromide solution were added by the double jet method, while keeping the pAg and pH were maintained at 9.8 and 5.0, respectively.

During the grain formation, each of the solutions was added at an optimal flow rate so as not to cause nucleation or Ostwald ripening. After completing the addition, the emulsion desalted at 40° C. by the conventional flocculation method, gelatin was added thereto and the emulsion was redispersed and adjusted to a pAg of 8.1 and a pH of 5.8. The resulting emulsion was comprised of tabular grains having an average size (an edge length of a cube with an equivalent volume) of 0.75 μm, average aspect ratio of 5.0 and exhibiting the iodide content from the grain interior of 2/8.5/X/3 mol %, in which X represents the dislocation line-introducing position. From electron microscopic observation, it was proved that at least 60% of the total grain projected area was accounted for by grains having 5 or more dislocation lines both in fringe portions and in the interior of the grain. The silver iodide content of the surface was 6.7 mol %.

Preparation of Silver Iodobromide f

Silver iodobromide f was prepared in the same manner as silver iodobromide d, except that in the step 1), the pAg, the amount of silver nitrate to be added and the SMC-1 amount were varied to 8.8, 2.077 mol and 0.218 mol, respectively; and in the step 3), the amounts of silver nitrate and SMC-1 were varied to 0.91 mol and 0.079 mol, respectively. The resulting emulsion was comprised of tabular grains having an average size (an edge length of a cube with an equivalent volume) of 0.65 μm, average aspect ratio of 6.5 and exhibiting the iodide content from the grain interior of 2/9.5/X/8 mol %, in which X represents the dislocation line-introducing position. From electron microscopic observation, it was proved that at least 60% of the total grain projected area was accounted for by grains having 5 or more dislocation lines both in fringe portions and in the interior of the grain. The silver iodide content of the surface was 11.9 mol %.

The thus prepared silver iodobromide d and f were added with sensitizing dyes afore-described and ripened, and then chemically sensitized by adding triphenylphosphine selenide, sodium thiosulfate, chloroauric acid and potassium thiocyanate until relationship between sensitivity and fog reached an optimum point. Silver iodobromide a, b, c, g, h, and i were each spectrally and chemically sensitized in a manner similar to silver iodobromide d and f.

In addition to the above composition were added coating aids SU-2, SU-4 and SU-5; a dispersing aid SU-1; viscosity-adjusting agent V-1; stabilizers ST-5 and ST-6; fog restrainer AF-1 and AF-2 comprising two kinds polyvinyl pyrrolidone of weight-averaged molecular weights of 10,000 and 1.100,000; inhibitors AF-3, AF-4 and AF-5; hardener H-1 and H-3; and antiseptic F-1.

Chemical formulas of compounds used in the Samples described above are shown below.

SU-1

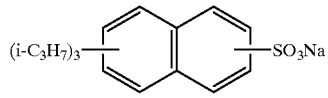

SU-2

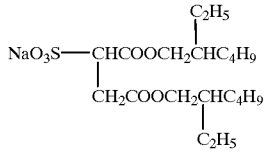

SU-4: $C_8F_{17}SO_2N(C_3H_7)CH_2COOK$

SU-5 $C_8F_{17}SO_2NH(CH_2)_3N^+(CH_3)_3Br^-$

ST-5: 4-hydroxy-6-methyl-1,3,3a,7-tetraazaindene

ST-6: Adenine

AF-3: 1-Phenyl-5-mercaptotetrazole

AF-4: 1-(4-Carboxyphenyl)-5-mercaptotetrazole

AF-5: 1-(3-Acetoamidophenyl)-5-mercaptotetrazole

H-1: $C(CH_2{=}SO_2CH_2)_4$

H-3: $[CH_2{=}CHSO_2CH_2)_3CCH_2SO_2CH_2CH_2]_2NCH_2CH_2SO_3K$

OIL-1: Tricresyl phosphate

OIL-2: Di(2-ethylhexyl)phthalate

AS-1: 2,5-Bis(1,1-dimethyl-4-hexyloxycarbonylbutyl)-hydroquinone

As-2: Dodecyl gallate

AS-3: 1,4-Bis(2-tetradecyloxycarbonylethyl)piperazine

C-3

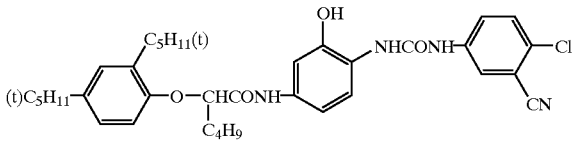

C-4

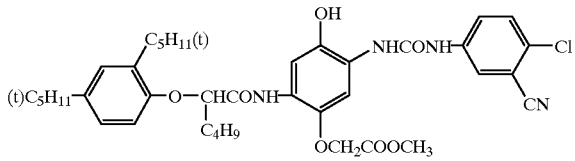

-continued
C-5
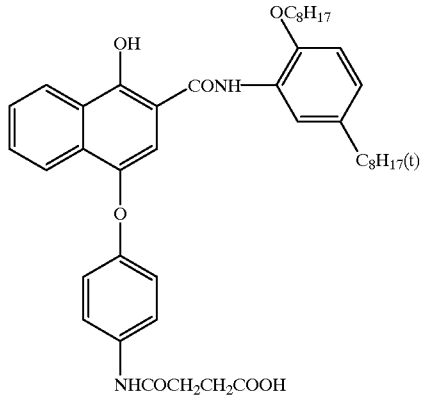
M-1
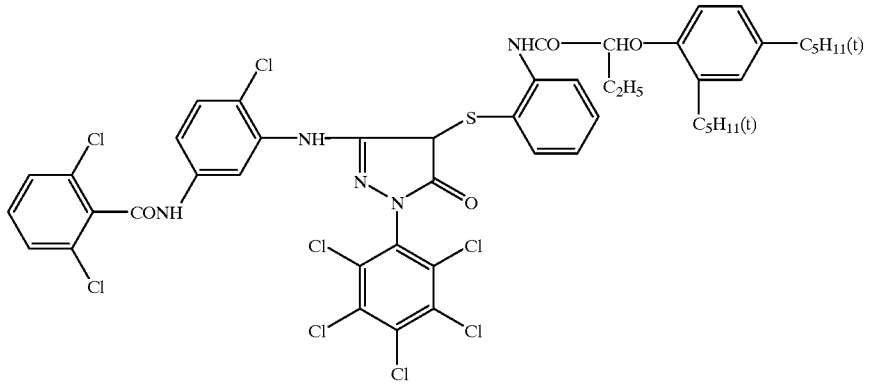
Y-5
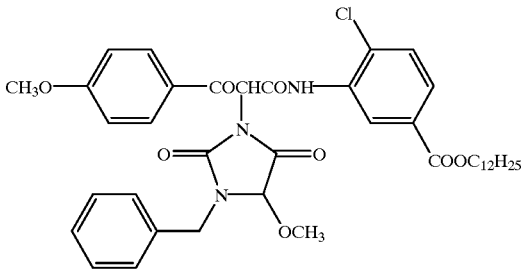
CC-1
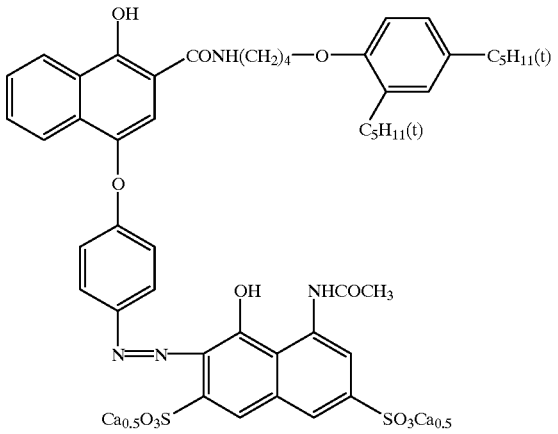
CM-1
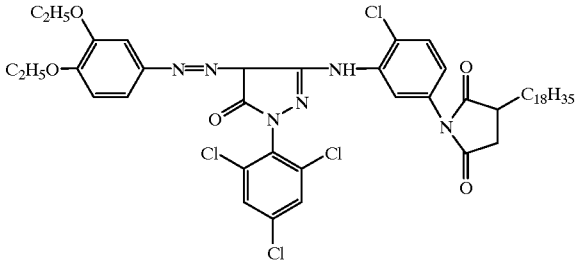

-continued
CM-2
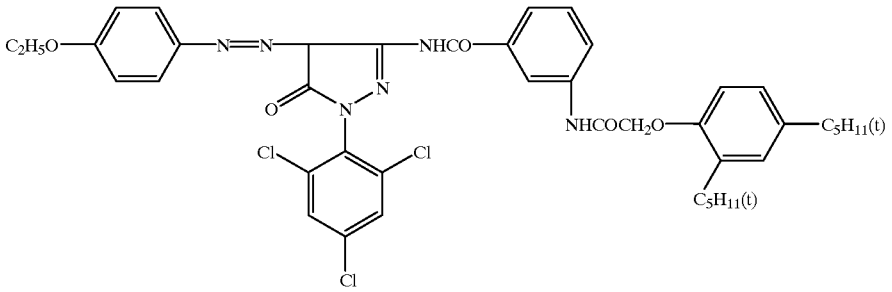
DI-1
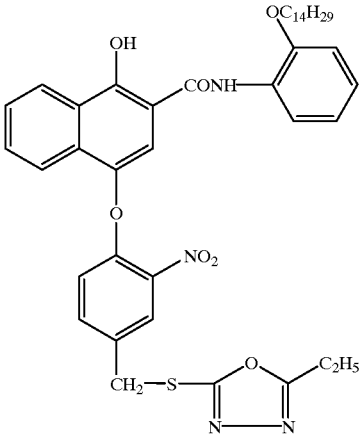
DI-2
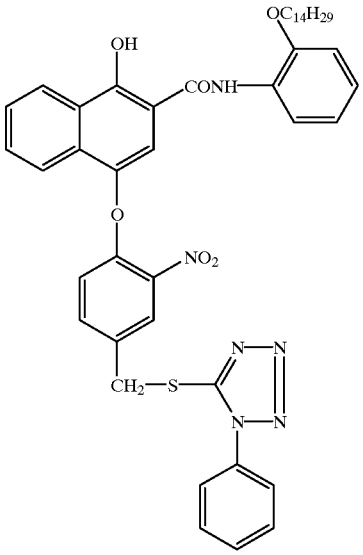
DI-3
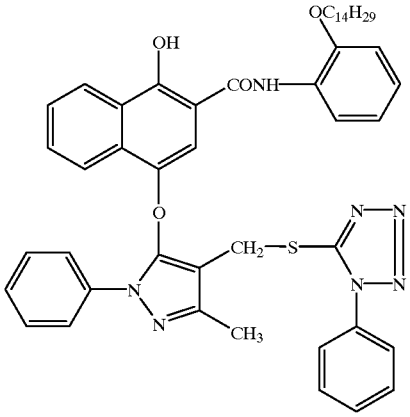
DI-4
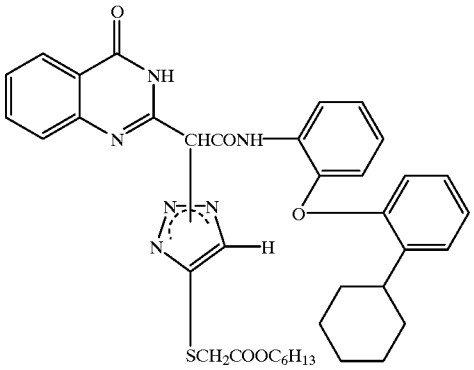
SD-1
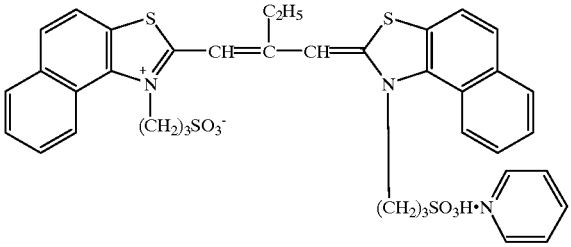
SD-2
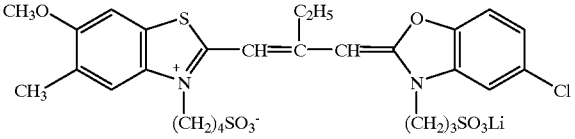

-continued

SD-3

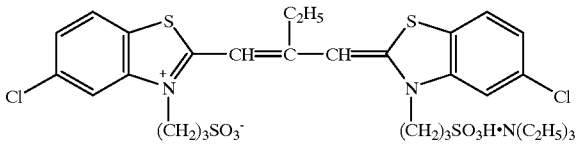

SD-4

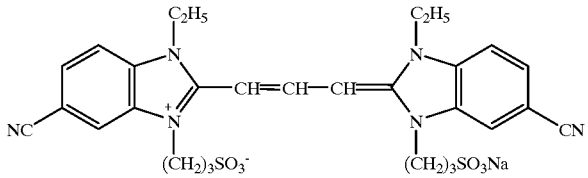

SD-5

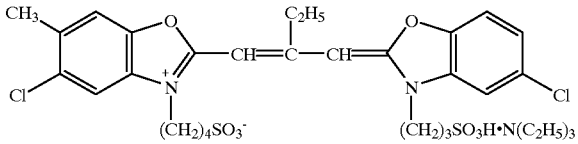

SD-6

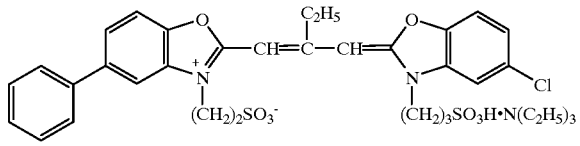

SD-7

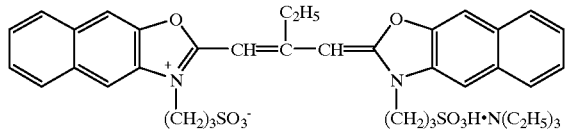

SD-8

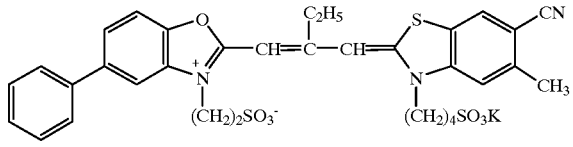

SD-9

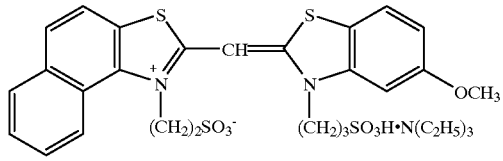

SD-10

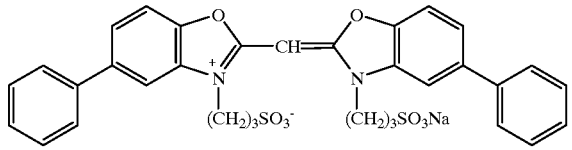

WAX-1

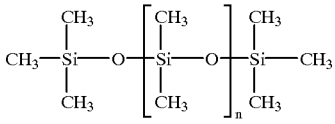

Mw = 3,000

AI-5

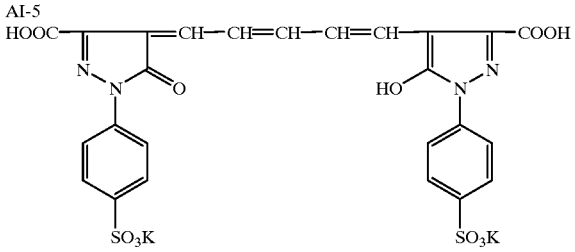

PM-1

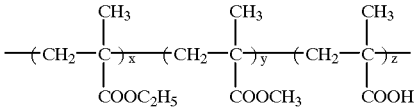

x:y:z = 3:3:4

PM-2

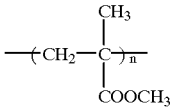

n:Degree of polymerization

UV-3

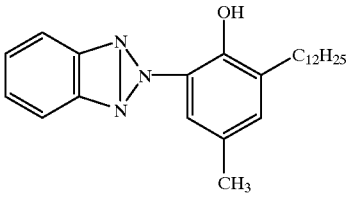

UV-4

V-1

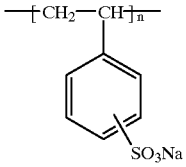

n:Degree of polymerization

F-1

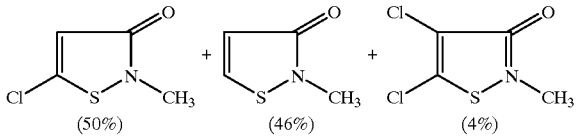

(50%) (46%) (4%)

Molar ratio

Sample 201 thus prepared was exposed through an optical wedge used for sensitometry to white light and processed according to the following process (I).

Further, comparative Samples 202 through 206 and inventive Samples 207 through 211 were each prepared in a similar manner to Sample 201, except that an yellow coupler (Y-5) used in the 12th and 13th layers were replaced by comparative couplers or inventive couplers, as shown in Table 2. In this case, each yellow coupler was used in a molar amount equivalent to that of Sample 201 and the amount of high boiling solvent (OIL-1) was so adjusted that the weight ratio of the yellow coupler to the high boiling solvent was constant.

Structures of comparative couplers are shown below.

Comparative coupler Y-6

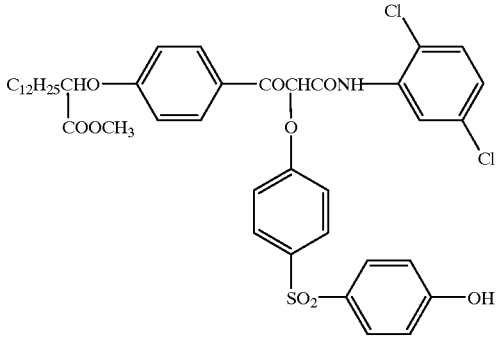

(Coupler described in EP 327,348)

Comparative coupler Y-7

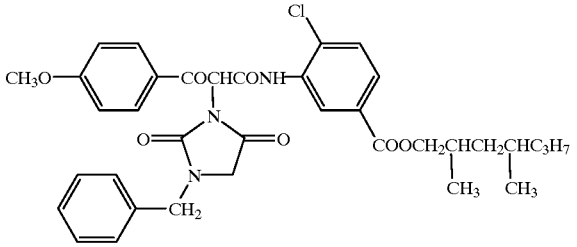

(Coupler described in JP-A 3-84546)

Comparative coupler Y-8

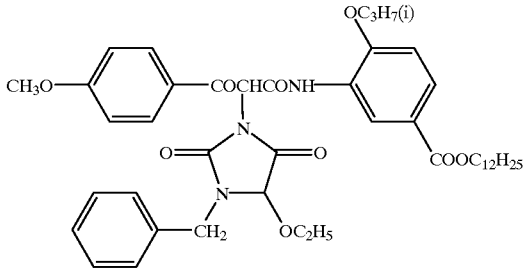

(Coupler described in EP 897,133)

Comparative coupler Y-9

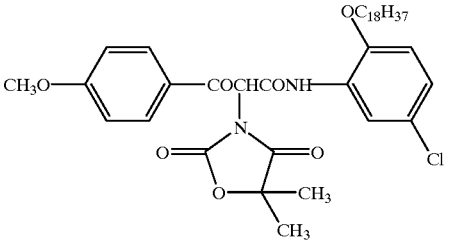

(Coupler described in JP-A 10-198008)

-continued

Comparative coupler Y-10

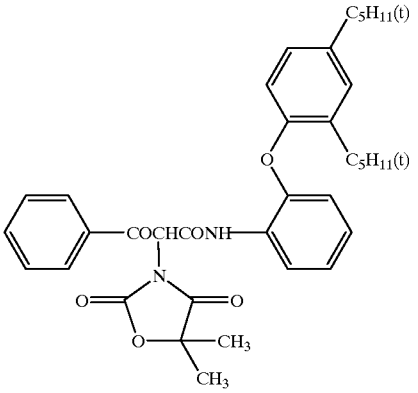

(Coupler described in JP-A 10-198008)

Samples each were exposed through an optical wedge for sensitometry to white light for 1/100 sec. and processed according to the following process. The thus processed samples were measured with respect to the maximum color density (Dmax) and the minimum color density (Dmin), using an optical densitometer, PDA-65 (available from Konica Corp.).

Processing (I)

| Processing step | Time | Temperature | Replenishing rate* |
|---|---|---|---|
| Color developing | 3 min. 15 sec. | 38 ± 0.3° C. | 780 ml |
| Bleaching | 45 sec. | 38 ± 2.0° C. | 150 ml |
| Fixing | 1 min. 30 sec. | 38 ± 2.0° C. | 830 ml |
| Stabilizing | 60 sec. | 38 ± 5.0° C. | 830 ml |
| Drying | 1 min. | 55 ± 5.0° C. | — |

*:Amounts per $m^2$ of photographic material

A color developer, bleach, fixer, stabilizer and their replenishers were each prepared according to the following formulas.

Color developer and replenisher thereof:

| | Worker | Replenisher |
|---|---|---|
| Water | 800 ml | 800 ml |
| Potassium carbonate | 30 g | 35 g |
| Sodium hydrogencarbonate | 2.5 g | 3.0 g |
| Potassium sulfite | 3.0 g | 5.0 g |
| Sodium bromide | 1.3 g | 0.4 g |
| Potassium iodide | 1.2 mg | — |
| Hydroxylamine sulfate | 2.5 g | 3.1 g |
| Sodium chloride | 0.6 g | — |
| 4-Amino-3-methyl-N-(β-hydroxyethyl)-aniline sulfate | 4.5 g | 6.3 g |
| Diethylenetriaminepentaacetic acid | 3.0 g | 3.0 g |
| Potassium hydroxide | 1.2 g | 2.0 g |

Water was added to make 1 liter in total, and the pH of the developer and its replenisher were each adjusted to 10.06 and 10.18, respectively with potassium hydroxide and sulfuric acid.

Bleach and replenisher thereof:

| | Worker | Replenisher |
|---|---|---|
| Water | 700 ml | 700 ml |
| Ammonium iron (III) 1,3-diamino-propanetetraacetic acid | 125 g | 175 g |
| Ethylenediaminetetraacetic acid | 2 g | 2 g |
| Sodium nitrate | 40 g | 50 g |
| Ammonium bromide | 150 g | 200 g |
| Glacial acetic acid | 40 g | 56 g |

Water was added to make 1 liter in total and the pH of the bleach and its replenisher were adjusted to 4.4 and 4.0, respectively, with ammoniacal water or glacial acetic acid.

Fixer and replenisher thereof:

| | Worker | Replenisher |
|---|---|---|
| Water | 800 ml | 800 ml |
| Ammonium thiocyanate | 120 g | 150 g |
| Ammonium thiosulfate | 150 g | 180 g |
| Sodium sulfite | 15 g | 20 g |
| Ethyienediaminetetraacetic acid | 2 g | 2 g |

Water was added to make 1 liter in total and the pH of the fixer and replenisher thereof were adjusted to 6.2 and 6.5, respectively, with ammoniacal water or glacial acetic acid.

Stabilizer and its replenisher:

| | |
|---|---|
| Water | 900 ml |
| p-Octylphenol/ethyleneoxide (10 mol) adduct | 2.0 g |
| Dimethylolurea | 0.5 g |
| Hexamethylenetetramine | 0.2 g |
| 1,2-benzoisothiazoline-3-one | 0.1 g |
| Siloxane (L-77, product by UCC) | 0.1 g |
| Ammoniacal water | 0.5 ml |

Water was added to make 1 liter in total and the pH thereof was adjusted to 8.5 with ammoniacal water or sulfuric acid (50%).

Results are shown in Table 2.

TABLE 2

| Sample | Coupler | Dmax | Dmin |
|---|---|---|---|
| 201 (Comp.) | Y-5 | 2.19 | 0.18 |
| 202 (Comp.) | Y-6 | 2.23 | 0.25 |
| 203 (Comp.) | Y-7 | 2.12 | 0.15 |
| 204 (Comp.) | Y-8 | 2.25 | 0.19 |
| 205 (Comp.) | Y-9 | 2.29 | 0.14 |
| 206 (Comp.) | Y-10 | 2.26 | 0.14 |
| 207 (Inv.) | III-3 | 2.41 | 0.12 |
| 208 (Inv.) | III-7 | 2.37 | 0.10 |
| 209 (Inv.) | III-10 | 2.39 | 0.11 |
| 210 (Inv.) | III-31 | 2.36 | 0.12 |
| 211 (Inv.) | III-42 | 2.45 | 0.10 |

As apparent from Table 2, it is shown that Samples 201 to 206 using comparative couplers Y-5, Y-6, Y-7, Y-8, Y-9 and Y-10 exhibited inferior dye forming capability and higher fogging. It is further shown that Samples 207 to 211 using inventive couplers each formed color images exhibiting a higher maximum density and a lower fog density, as compared to comparative samples.

Example 3

Photographic material Samples 301 through 311 were prepared in a similar manner to Example 2. The thus prepared samples were exposed through a stepped wedge for sensitometry to white light for 1/100 sec. and processed according to process (II), in which the pH of the color developer of process (I) was varied to 9.90. Processed samples were measured with respect to the maximum color density (Dmax). The maximum color density and variation in Dmax with the pH of developer (denoted as "pH variation") are shown in Table 3. The pH variation was determined based on the following relationship:

[Dmax in process (II)/Dmax in process (I)]×100

TABLE 3

| Sample | Coupler | Dmax | pH Variation |
|---|---|---|---|
| 301 (Comp.) | Y-5 | 1.84 | 84 |
| 302 (Comp.) | Y-6 | 1.81 | 79 |
| 303 (Comp.) | Y-7 | 1.72 | 81 |
| 304 (Comp.) | Y-8 | 1.98 | 88 |
| 305 (Comp.) | Y-9 | 2.11 | 92 |
| 306 (Comp.) | Y-10 | 2.06 | 91 |
| 307 (Inv.) | III-3 | 2.34 | 97 |
| 308 (Inv.) | III-7 | 2.25 | 95 |
| 309 (Inv.) | III-10 | 2.29 | 96 |
| 310 (Inv.) | III-31 | 2.24 | 95 |
| 311 (Inv.) | III-42 | 2.40 | 98 |

As can be seen from Table 3, it is shown that comparative Samples 301 to 306 using comparative couplers Y-5, Y-6, Y-7, Y-8, Y-9 and Y-10 exhibited reduced maximum color densities. It is further shown that inventive Samples 307 to 311 using inventive couplers formed color images exhibiting less variation in the maximum color density, compared to comparative samples.

As explained in the foregoing, silver halide color photographic materials containing a novel yellow coupler exhibiting superior dye forming capability, enhanced solubility in a solvent and improved dispersion stability can be provided according to the present invention.

What is claimed is:

1. A silver halide light sensitive color photographic material comprising a support having thereon a silver halide emulsion layer, wherein the photographic material comprises a coupler represented by the following formula (III):

formula (III)

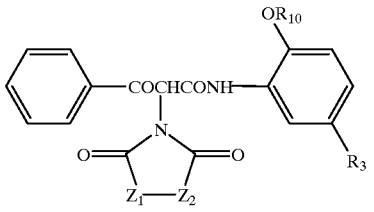

wherein $R_{10}$ is a ballasted alkyl group; $R_3$ is a hydrogen atom or a halogen atom; $Z_1$ is >N—$R_4$ or —O—, in which $R_4$ is a hydrogen atom, an alkyl group, a cycloalkyl group, an aryl group or a heterocyclic group; $Z_2$ is >N—$R_5$ or >C($R_6$)($R_7$), in which $R_5$ is a hydrogen atom, an alkyl group, a cycloalkyl group, an aryl group or a heterocyclic group, and $R_6$ and $R_7$ are each a hydrogen atom or a substituent.

2. The silver halide color photographic material of claim 1, wherein in formula (III), $R_3$ is a chlorine atom.

3. The silver halide color photographic material of claim 1, wherein $R_{10}$ is an unsubstituted alkyl group having 8 to 21 carbon atoms.

4. The silver halide color photographic material of claim 2, wherein $R_{10}$ is an unsubstituted alkyl group having 8 to 21 carbon atoms.

5. The silver halide color photographic material of claim 1, wherein in formula (III), $R_{10}$ is a group represented by the following formula (IV):

formula (IV)

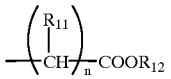

wherein $R_{11}$ is a hydrogen a atom, an alkyl group, a cycloalkyl group or an a aryl group; $R_{12}$ is an alkyl group or a cycloalkyl group; n is an integer of 1 to 10.

* * * * *